United States Patent [19]

Steiger

[11] Patent Number: 4,758,169

[45] Date of Patent: Jul. 19, 1988

[54] INJECTION VALVE FOR RECIPROCATING INTERNAL COMBUSTION ENGINE

[75] Inventor: Anton Steiger, Illnau, Switzerland

[73] Assignee: Sulzer Brothers Limited, Winterthur, Switzerland

[21] Appl. No.: 11,202

[22] Filed: Feb. 4, 1987

[30] Foreign Application Priority Data

Feb. 12, 1986 [CH] Switzerland ..... 563/86

[51] Int. Cl.[4] ..... F02M 41/16

[52] U.S. Cl. ..... 239/96; 239/446; 239/533.5; 239/533.8

[58] Field of Search ..... 239/533.3–533.12, 239/446, 96

[56] References Cited

U.S. PATENT DOCUMENTS 3,640,466 2/1972 Steiger ..... 239/96
4,168,804 9/1979 Hofmann ..... 239/533.11
4,269,360 5/1981 Kopse ..... 239/533.8
4,285,471 8/1981 Eblen et al. ..... 239/533.4

FOREIGN PATENT DOCUMENTS 2014215 10/1971 Fed. Rep. of Germany ... 239/533.3
3237881 4/1984 Fed. Rep. of Germany ... 239/533.9

*Primary Examiner*—Andres Kashnikow
*Assistant Examiner*—Michael J. Forman
*Attorney, Agent, or Firm*—Kenyon & Kenyon

[57] ABSTRACT

The fuel injection valve is constructed of a valve body and a single valve needle. The valve needle operates under the pressure of the fuel to move a first distance permitting injection of fuel through the bottom nozzle of the valve body into a combustion chamber and moves a greater distance to expose the remaining nozzles to inject additional fuel into the combustion chamber. The valve needle has a conical end face which sealingly engages a valve seat of the valve body disposed between the respective set of nozzles when in the closed position.

6 Claims, 3 Drawing Sheets

INJECTION VALVE FOR RECIPROCATING INTERNAL COMBUSTION ENGINE

This invention relates to an injection valve for a reciprocating internal combustion engine.

Heretofore, various types of injection valves have been known for use in reciprocating internal combustion engines. In some cases, the injection valves have been constructed to inject small quantities of fuel as well as large quantities of fuel at different times. For example, in the case of a diesel engine, a small injected quantity may be injected "at part-load" while a large injected quantity is injected "at full-load". In this case, the small injected quantity may also be the amount otherwise referred as the "pre-injection". In the case of diesel-gas engines, the small injected quantity may be the amount of ignition oil which is injected.

Swiss Patent No. 623,114 describes an injection valve of the above type wherein use is made of two valve needles arranged in a valve body and cooperating with separate injection nozzles. In this case, the valve needles are arranged coaxially one inside the other. During a part-load operation of the engine, fuel is fed to the combustion chamber only via a top injection aperture or a top row of injection apertures while at full engine load, the fuel reaches the combustion chamber via the bottom injection aperture or the bottom row of injection apertures. In such a valve, there are also two separate and separately controlled fuel supplies in addition to the two valve needles. Thus, the construction of the overall valve is relatively complicated.

Accordingly, it is an object of the invention to provide a simplified injection valve for injecting different quantities of fuel into a combustion chamber.

It is another object of the invention to simplify the construction of an injection valve for injecting different quantities of fuel at different times.

Briefly, the invention provides an injection valve for a reciprocating internal combustion engine which is comprised of a valve body and a single valve needle.

The valve body is constructed with at least one nozzle in an end face for injecting fuel into a combustion chamber, at least a second nozzle in spaced longitudinal relation to the first nozzle for injecting fuel into the combustion chamber, an annular valve seat disposed between the two nozzles and a fuel supply duct which extends in the valve body.

The valve needle is movably mounted axially within the valve body. In addition, the valve needle has an end face which is sealingly seated on the valve seat, a duct which extends from the end face and which communicates with the fuel supply duct in the valve body and a cylindrical part which extends from the end face to seal over the second nozzle in the valve body. The valve needle is dimensioned such that movement of the needle from the valve seat a first predetermined distance communicates the fuel supply duct in the valve body with the duct in the needle and, thus, with the first nozzle in order to eject fuel into the combustion chamber. Additional movement of the valve thereafter communicates the fuel supply duct via the needle duct with the second nozzle in order to eject an additional fuel into the combustion chamber.

The valve body also includes an annular groove which is coaxial of the cylindrical part of the valve needle and which communicates with the supply duct in the valve body. In addition, the annular groove extends over that half of the axial length of the valve needle which is remote from the combustion chamber.

The valve may be operated, depending upon the use of the valve, so that fuel is injected into a combustion chamber only through the bottom (i.e. first) nozzle or initially only via the bottom nozzle. This is accomplished since the movement of the valve needle within the valve body can be controlled so that the flow through the upper (i.e. second) nozzle is shut off. Should the fuel throughput increase, the valve needle travel also increases so that the upper injection nozzle is also open for the fuel supply.

Since the annular groove in the valve body which communicates with the supply duct is filled with fuel and injection pressure, the part of the valve body surrounding the valve needle is practically not increased in diameter. Hence, the width of the gap between the cylindrical surface of the valve needle and the corresponding bore in the valve body remains relatively small. Consequently, leakage of fuel through this gap is reduced to a negligible amount.

The valve possess an additional advantage in that the valve can be used both on the displacement principle and the time-controlled principle, i.e. with a fuel accumulator in the valve body.

The valve body is also provided with a fuel accumulator chamber for receiving fuel as well as a loading piston in communication with the chamber to abut the valve needle under the pressure of the fuel in the chamber and with a spring biasing the valve needle against the valve seat. Further, a replenishment duct may extend from the accumulator chamber to an actuated side of the piston with the replenishment duct being of a length sufficient to prevent fuel from flowing out of the chamber during injection of fuel from the nozzles.

These and other objects and advantages of the invention will become more apparent from the following detailed description taken in conjunction with the accompanying drawings wherein each Fig. shows an axial section.

Figure 1:
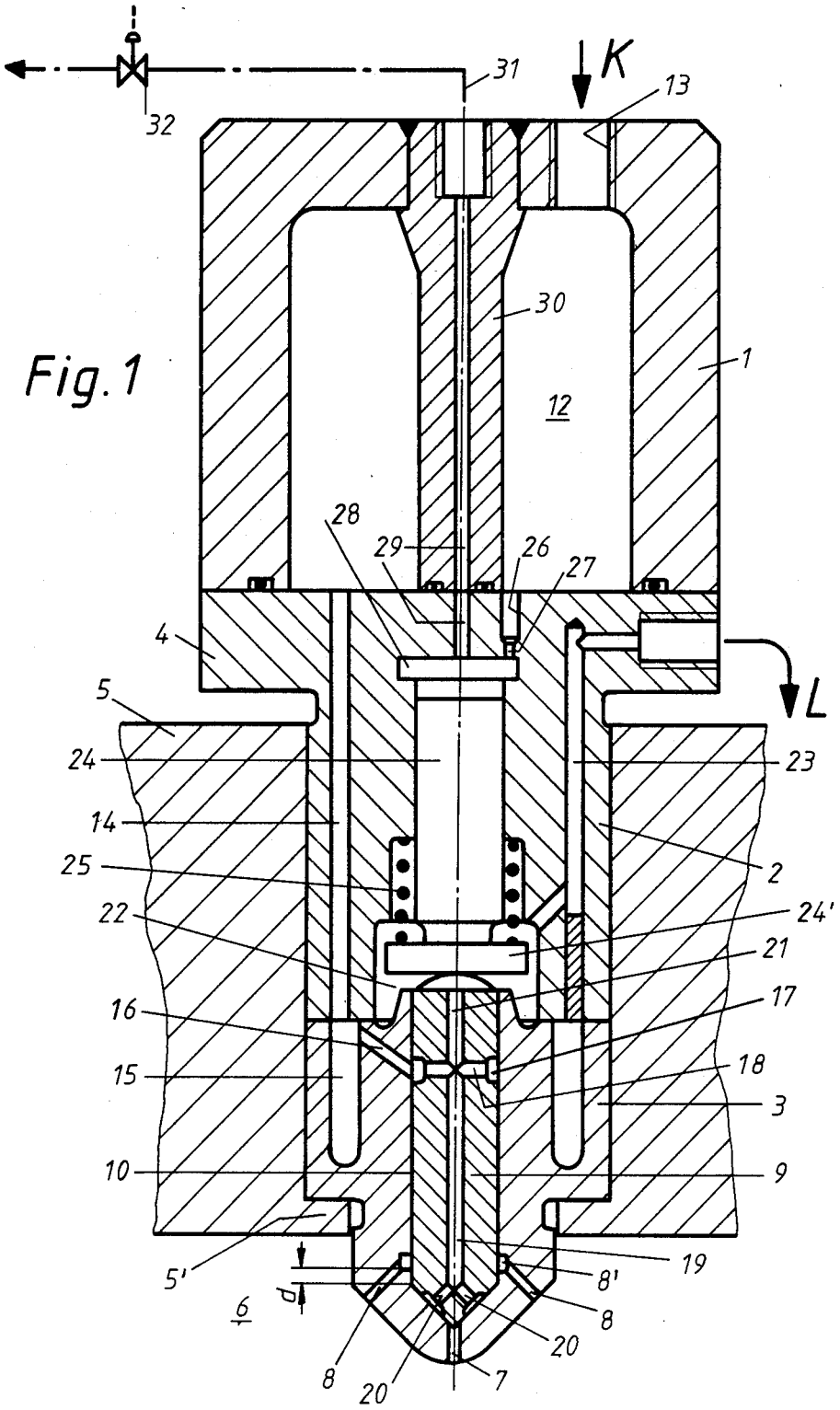
FIG. 1 illustrates a timed injection valve constructed in accordance with the invention.

Referring to FIG. 1, the injection valve includes a valve body which consists of three parts, i.e. a top part 1, a middle part 2 and a bottom part 3 which are held together with suitable means (not shown). As indicated, the bottom part 3 of the valve body rests via a step on a shoulder 5' of a cylinder head 5 which closes the top of a combustion chamber 6 of a cylinder (not shown). As indicated, the bottom part 3 of the valve body extends through the cylinder head 5 and projects into the combustion chamber 6. In addition, the bottom part 3 of the valve body is formed with a central injection nozzle 7 and two or more injection nozzles 8 at a higher level as viewed. As indicated, the central nozzle 7 is disposed on the longitudinal axis of the valve body while the nozzles 8 are in spaced longitudinal relation to the nozzle 7 on axes which are at an acute angle to the longtidinal axis of the valve body.

The bottom part 3 of the valve body is also provided with an annular valve seat between the nozzles 7, 8 and an annular groove 8' in an axial bore 10 which communicates with the upper nozzles 8. As indicated, the bottom of the groove 8' is spaced a distance d from the upper end of the valve seat.

The valve also includes a valve needle 9 which is movably mounted axially and within the bore 10 of the bottom part 3. This needle 9 has a conical end face which is sealingly seated on the valve seat of the valve body 3 and a cylindrical part which extends from the end face to seal over the annular groove 8' and the nozzles 8. The needle 9 is disposed within the bottom part 3 of the valve body to move axially. However, the distance d is smaller than the maximum travel of the valve needle 9 at full load of the diesel engine and larger than the valve needle travel at part load or than the needle travel for ignition oil injection when the valve is installed in a diesel-gas engine which operates with gas.

The top part 1 of the valve body contains an accumulator chamber 12 in which fuel for injection, for example, diesel oil, is stored under high pressure and is supplied via an aperture 13 and a line denoted by the arrow K by means of a fuel pump (not shown). The middle part 2 of the valve has a duct 14 which extends axially from the accumulator chamber 12 into an annular groove 15 within the bottom part 3. This annular groove 15 starts from the joint between the parts 2, 3 and extends approximately as far as the middle of the cylindrical length of the bore 10 guiding the valve needle 9. As indicated, the annular groove 15 surrounds the valve needle 9 coaxially. In addition, an inclined duct 16 extends from the top end of the annular groove 15 and leads into the bore 10.

In the region of the opening of the inclined duct 16, the valve needle 9 has an annular groove 17 into which a diametrically disposed duct 18 leads. In addition, a central duct 19 extends through the needle 9 and communicates with the diametric duct 18 so as to receive fuel oil therefrom. At the terminal end, the central duct 19 communicates with a pair of short branch ducts 20, each of which extends to the conical end face of the needle 9. As indicated, the axis of each branch duct 20 is at a right angle to the conical surface of the end face of the needle 9. The outlet zone of each duct 20 is widened somewhat to an extent such that there are still sealing parts of the conical surface remaining on each side in order to block any flow of fuel to the nozzles 7, 8 when the valve needle 9 is in the closed position illustrated. Since, for manufacturing reasons, the central duct 19 must be drilled from the top end of the needle 9, but the portion situated above the diametric duct 18 is not desired, a closure element 21, in the form of a rivet is fitted in seal tight relationship in this part of the duct 19 with a shank terminating at the top boundary of the diametric duct 18.

A fuel accumulator chamber 22 is provided at the bottom end of the middle part 2 of the valve body for receiving leakage fuel from between the needle 9 and the bottom part 3. In addition, a leakage duct 23 extends from the chamber 22 through the middle part 2 and terminates in a flange 4 of the middle part 2. A suitable leakage line (not shown) as indicated by the arrow L may be provided for the discharge of fuel from the duct 23.

A loading piston 24 is slidably mounted within the middle part 2 and projects into the leakage chamber 22 to abut the needle 9 via the closure element 21 under the bias of a spring 25 which bears against a flange 24' at the bottom end of the piston 24. A duct 26 is provided in the middle part 2 and leads from the accumulator chamber 12 via a constriction 27 into a space 28 above the loading piston 24 in order to load the top end face of the piston 24. In this regard, the diameter of the loading piston 24 is made somewhat larger than the diameter of the needle 9.

A relief duct 29 extends from the space 28 through a bolt 30 disposed within the accumulator chamber 12 in seal tight manner to a line 31 for the discharge of pressurized fuel. As indicated, a control valve 32 is disposed in the line 31 to control the discharge of the fuel in the line 31.

The operation of the injection valve is as follows.

In the case of small injected quantites, i.e. a short stroke of the valve needle 9 which is smaller than the distance d, fuel flows from the accumulator chamber 12 via the ducts 14 and 16 to the annular groove 17 in the valve needle 9. Thereafter, the fuel flows through the ducts 18, 19, 20 into the widenings surrounding the branch ducts 20 between the conical end face of the valve needle 9 and the valve seat of the housing part 3.

The pressure of the fuel between the conical end face of the needle 9 and the valve seat of the bottom part 3 is such that the needle 9 moves upwardly, as viewed, to produce a gap corresponding to a small stroke of the needle 9 so that fuel flows through the bottom nozzle 7 into the combustion chamber 6 of the cylinder.

A very small leakage quantity will also pass into the annular groove 8' under the above conditions. However, in view of the short opening time of the valve needle, this quantity can be disregarded.

The start of the stroke of the valve needle 9 is initiated by the fact that the control valve 32, which is closed between the injection phases, is opened so that the fuel pressure acting on the loading piston 24 in the space 28 is relieved via the duct 29 and the line 31. The lifting force of the valve needle 9 is then determined by the projecting surface of the widening surrounding the short branch ducts 20. A substantial flow of fuel from the accumulator chamber 12 to the chamber 28 during the relief of the chamber 28 is prevented by the constriction 27. With the closing of the control valve 32, the pressure building up in the chamber 28 again predominates so that the valve needle 9 is moved into the closed position via the loading piston 24 and the injection operation through the injection nozzle 7 is terminated. The amount injected with this method is relatively small.

In the case of larger injected quantities, the travel or stroke of the valve needle 9 is made larger than the distance d so that the fuel also flows via the annular groove 8' through the nozzles 8. This longer valve needle stroke is obtained by keeping the valve 32 open for a longer period.

The provision of the annular groove 15 in the bottom part 3 has the effect that the leakage which would otherwise occur between the bore 10 and the cylindrical outer surface of the valve needle 9 is drastically reduced. As a result of the fuel pressure which is operative in the annular groove 15, widening of the sealing gap between the cylindrical outer surface of the valve needle 9 and the bore 10 is prevented in practice. The width of this gap is restricted to a few μm, i.e. to the value required to allow free play of the valve needle. The same limitation of the gap width is also applied in that part of the valve needle 9 which is situated between the annular groove 17 and the leakage chamber 22, because the joint between the middle housing part 2 and the bottom housing part 3 being situated approximately in the middle of the axial length of the upper part of the valve needle 9 which part is situated between the groove 17 and the chamber 22.

As illustrated in FIG. 1, the groove 15 extends over that half of the axial length of the valve needle 9 which is remote from the combustion chamber 6.

Figure 2:
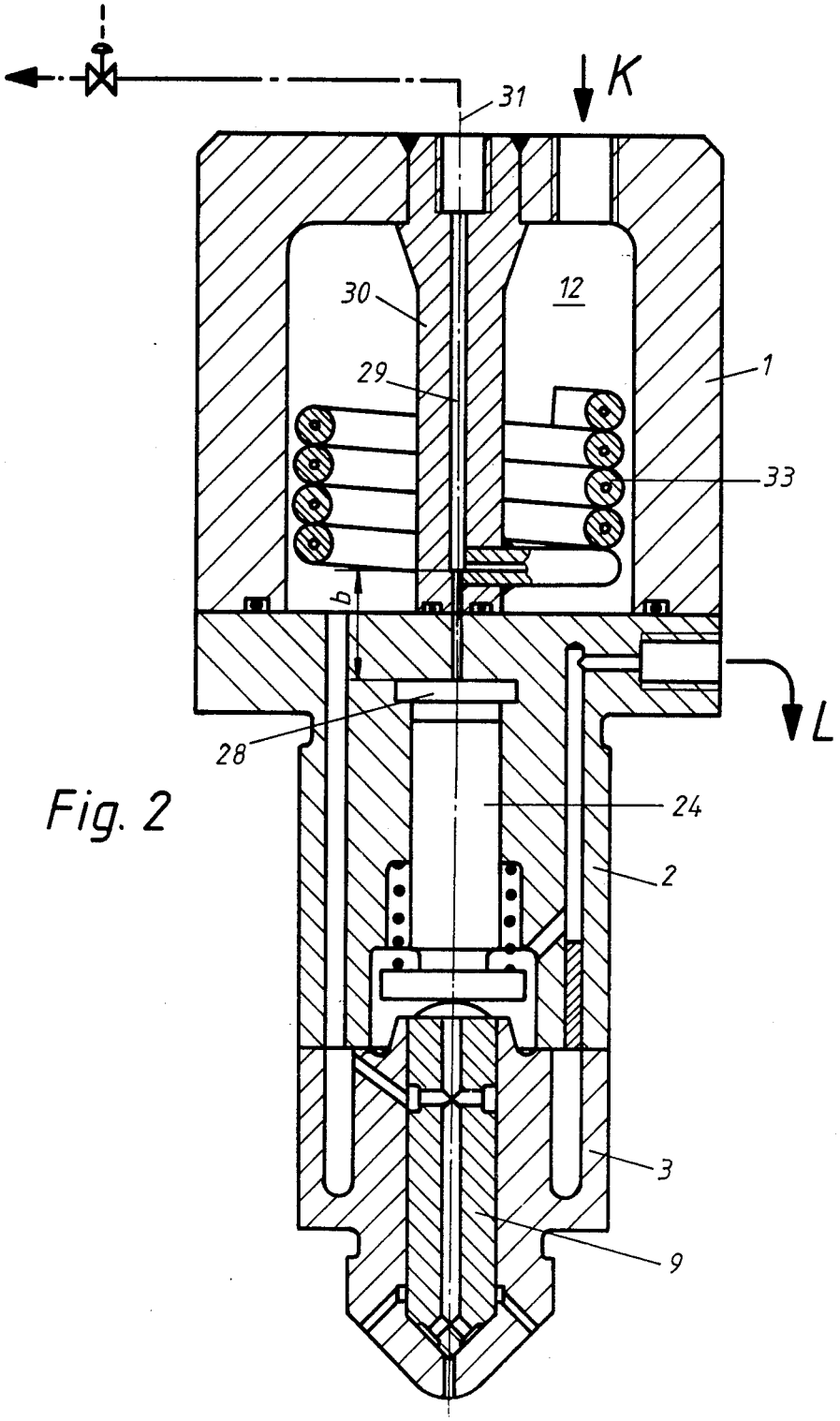
FIG. 2 illustrates a modified timed injection valve constructed in accordance with the invention.

Referring to FIG. 2 wherein like reference characters indicate like parts as above, a replenishment duct 33 in the form of a helical tube may communicate the space 28 above the loading piston 24 with the interior of the accumulator chamber 12 instead of using a constriction 27 as in FIG. 1. In this case, one end of the tubing 33 communicates with the relief duct 29 while the other end communicates with the accumulator chamber 12. The distance between the branching-off point of the tubing 33 from the chamber 28 is denoted by the distance b and should correspond, at the maximum, to the length of the tubing itself. This length is determined by the following equation:

$$L=0.5\times t\times a$$

wherein t is the required injection of time for ignition oil injection in the case of gas operation and "a" is the speed of sound in the fuel used.

The free cross-section of the tubing 33 and the free cross-section of the duct part between the chamber 28 and the branch-off point should preferably be half the cross-section of the duct 29 adjoining the branch-off point and of the line 31 in which the control valve 32 is disposed.

The injection valve in FIG. 2 operates in the same way as described in connection with the injection valve shown in FIG. 1. The provision of the tubing 33, however, has the effect that during the injection time "t", the lifting speed of the valve needle 9 is not reduced by any fuel flowing from the accumulator chamber 12 into the chamber 28.

The length of the tubing 33 is thus sufficient to prevent fuel from flowing out of the accumulator chamber 12 during injection of fuel from the nozzles.

Figure 3:
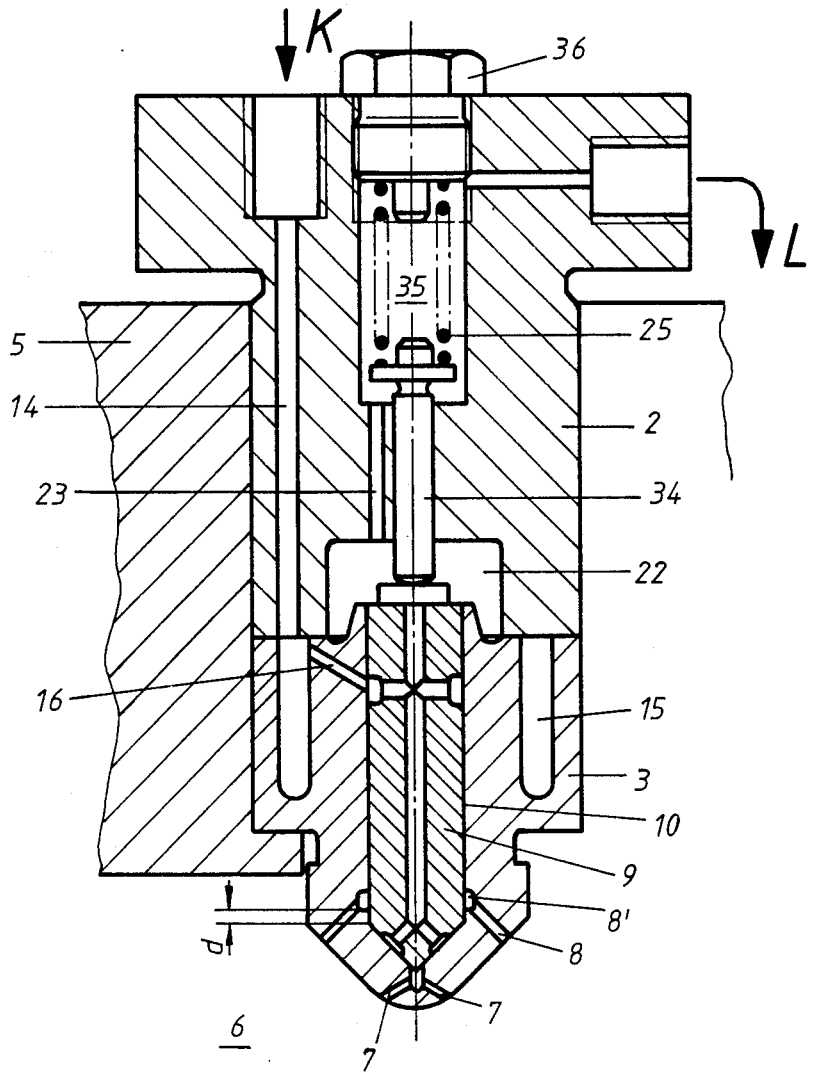
FIG. 3 illustrates a further modified valve according to the invention based on the displacement principle.

Referring to FIG. 3, wherein like reference characters indicate like parts as above, the valve may be constructed for operation under the displacement principle. In this case, the top part 1 with the accumulator chamber 12 and the loading piston 24 are eliminated. In addition, the fuel supply line denoted by the arrow K extending from the fuel pump (not shown) is connected directly to the fuel duct 14 of the valve part 2. In addition, the valve needle 9 is biased into the closing position by a central bolt 34 under the action of a spring 25. As indicated, the spring 25 is disposed in a chamber 35 situated in the top half of the valve part 2 and is closed at the top by a screw bolt 36. The leakage duct 23 connects the leakage chamber 22 to the chamber 35 while a leakage line indicated by the arrow L is connected to the chamber 35.

The injection valve of FIG. 3 operates in a similar way to the valve shown in FIG. 1. In this regard, fuel flows through the duct 14, 16 and 18, 19, 20 only to the injection nozzle 7 in the case of small injected quantities, i.e. a travel of the valve needle 9 which is smaller than the distance d. The fuel pressure under these conditions is such that the valve needle 9 is lifted from the valve seat against the pressure of the spring 25 without the annular groove 8′ being exposed. However, in the case of larger injected quantities, the fuel pressure is such that the valve needle 9 is lifted against the force of the spring 25 until the annular groove 8′ is also exposed so that fuel flows through the nozzles 8 as well into the combustion chamber 6. Here again, by means of the fuel pressure acting in the annular groove 15, the width of the gap between the bore 10 and the valve needle 9 is limited to a few μm and, thus, the leakage is greatly reduced.

In the embodiments illustrated in FIGS. 1 and 2, the constriction 27 and the constriction provided by the section b of the duct 29, respectively, may be replaced by a switchable fuel supply and discharge at the top end of the duct 29. During the time between two injections, fuel is then fed to the loading piston 24 at appropriately high pressure and the piston 24 holds the valve needle 9 in the closed position. During the injection phases, the duct 29 is switched to fuel discharge so that the loading piston 24 frees the valve needle 9 for a corresponding stroke.

The invention thus provides an injection valve of relatively simple construction which can be used to inject different quantities of fuel at different times.

Further, the invention provides an injection valve which can be readily controlled for the injection of small or large quantities of fuel from time-to-time.

What is claimed is:

1. An injection valve for a reciprocating internal combustion engine comprising a valve body having at least one nozzle in an end face thereof for injecting fuel into a combustion chamber, at least a second nozzle in spaced longitudinal relation to said first nozzle for injecting fuel into the combustion chamber, an annular valve seat disposed between said nozzles, an annular groove extending coaxially therein to receive a supply of fuel and a fuel supply duct extending from said groove; and a valve needle movably mounted within said valve body coaxially of said groove with said groove extending over that half of the axial length of said needle remote from the combustion chamber, said needle having and end face sealingly seated on said valve seat, a duct extending from said end face and communicating with said fuel supply duct in said valve body, and a cylindrical part extending from said end face and sealing over said second nozzle in said valve body whereby movement of said needle from said valve seat a first predetermined distance communicates said duct in said needle with said first nozzle to eject fuel therefrom and movement of said needle from said valve seat a greater distance than said first distance communicates said needle duct with said first nozzle and said second nozzle to eject fuel therefrom.

2. An injection valve as set forth in claim 1 wherein said valve body includes an annular groove coaxial of said cylindrical part of said valve needle and communicating with said second nozzle, said groove being spaced from said end face of said needle an amount equal to said first distance.

3. An injection valve as set forth in claim 2 wherein said valve body includes a pair of said second nozzles communicating with said groove.

4. An injection valve as set forth in claim 7 wherein said duct is a central duct and said valve needle has a conical end face and a pair of branch ducts extending from said central duct to said conical end face.

5. An injection valve as set forth in claim 1 which further comprises a fuel accumulator chamber for receiving fuel, a loading piston having an actuated side abutting said needle and a replenishment duct extending from said chamber to said actuated side of said piston of a length sufficient to prevent fuel from flowing out of said chamber during injection of fuel from said nozzles.

6. An injection valve as set forth in claim 1 wherein said fuel supply duct includes an annular groove in said body and an inclined duct extending from an upper end of said annular groove and said needle includes an annular groove communicating said inclined duct with said duct in said needle.

* * * * *

UNITED STATES PATENT AND TRADEMARK OFFICE

CERTIFICATE OF CORRECTION

PATENT NO. : 4,758,169

DATED : July 19, 1988

INVENTOR(S) : Anton Steiger

It is certified that error appears in the above-identified patent and that said Letters Patent is hereby corrected as shown below:

Column 6, line 40 "and" should be -an-
Column 6, line 62 "claim 7" should be -claim 1-

Signed and Sealed this

Twentieth Day of December, 1988

*Attest:*

*Attesting Officer*

DONALD J. QUIGG

*Commissioner of Patents and Trademarks*